United States Patent [19]

Lunt

[11] Patent Number: 4,745,636

[45] Date of Patent: May 24, 1988

[54] DISPOSABLE, NON-WOVEN APPAREL SHORTS

[76] Inventor: Audrey T. Lunt, 6371 Vermont Hill Rd., South Wales, N.Y. 14139

[21] Appl. No.: 16,110

[22] Filed: Feb. 18, 1987

[51] Int. Cl.[4] ..... A41B 9/08

[52] U.S. Cl. ..... 2/402; 2/403; 2/406

[58] Field of Search ..... 2/402, 403, 406, 404, 2/407, 243 R

[56] References Cited

U.S. PATENT DOCUMENTS

| | | | |
|---|---|---|---|
| 1,966,060 | 7/1934 | Cohen | 2/407 |
| 3,488,778 | 1/1970 | Goujon et al. | 2/402 |
| 3,560,292 | 2/1971 | Butter | 2/406 |
| 3,594,820 | 7/1971 | McCurry | 2/406 |
| 3,604,015 | 4/1971 | Dove | 2/406 X |
| 3,782,309 | 1/1974 | Lee | 2/406 |
| 3,819,401 | 6/1974 | Massengale et al. | 2/406 |
| 4,223,408 | 9/1980 | Sullivan | 2/238 |
| 4,602,388 | 7/1986 | Underwood et al. | 2/238 |

FOREIGN PATENT DOCUMENTS

| | | | |
|---|---|---|---|
| 2001659 | 7/1971 | Fed. Rep. of Germany | 2/402 |
| 962051 | 6/1964 | United Kingdom | 2/406 |
| 1144674 | 3/1969 | United Kingdom | 2/406 |

*Primary Examiner*—Ronald Feldbaum

*Attorney, Agent, or Firm*—Michael Ebert

[57] ABSTRACT

Disposable apparel shorts fabricated from a single blank of non-woven textile sheeting, the blank having opposing isosceles triangular indentations therein whose vertices lie at the opposite ends of a transverse center line. When the blank is folded on this line to form identical superposed sections, these constitute the front and rear sections of the shorts in which the upper margins of the sections define the waist, and the folded-over triangular indentations define the leg openings. The side margins of the front section are folded in and the corresponding side margins of the rear section are folded over the folded-in margins to define side vents in the leg openings to provide additional space, should it be required by the wearer. An elastic band is bonded in its stretched state to the inner surface of the upper margins of the sections to create a shirred circular waist which is expandable to conform to the waist of the wearer.

3 Claims, 1 Drawing Sheet

DISPOSABLE, NON-WOVEN APPAREL SHORTS

BACKGROUND OF INVENTION

1. Field of Invention

This invention relates generally to garments made of non-woven textiles, and more particularly to disposable underwear shorts fabricated of a single blank of non-woven polyester sheeting.

2. Status of Prior Art

In the apparel field, the term "shorts" generally means knee length or less than knee length trousers made in various styles for informal wear or sportswear. The term is also applicable to underwear drawers or briefs; for these, too, fit about the waist of the wearer and are provided with short leg sections. As used herein, the term "shorts" is intended to encompass all existing forms of drawers and briefs as well as panties, which are the feminine equivalent to these underwear garments.

Typically, underwear shorts are made of pieces of woven fabric which are sewed together. When shorts become soiled, they are laundered in a manner depending on the material from which they are fabricated. Thus, silk shorts normally require dry cleaning, whereas cotton and wash-and-wear polyester-cotton underwear shorts can be wet washed in automatic washing machines.

The need exists for low cost disposable underwear shorts that can be discarded after a single use without any significant economic loss. Thus, in the physical therapy facilities of hospitals which require patients to be clothed in shorts, the present cost of supplying patients with shorts is quite high, not only because they are made of relatively expensive woven material and must be stocked in a range of sizes, but also because the shorts, after a single use, must be laundered and carefully sterilized before they can be reused. And while both male and female patients in hospitals are provided with sterilized examination gowns or coats, these do not cover the lower trunk of the body; hence a short or panty for this purpose is usually necessary.

In such facilities, therefore, it would be desirable to have available low cost disposable underwear shorts in two or three basic waist sizes; that is, shorts which can accommodate individuals whose waists lie within a relatively broad range, rather than shorts which can fit only a particular waist size.

Similarly, in health spas equipped with saunas and hot tubs, resort hotels, gymnasiums, tennis and racquet ball courts, public pools, whirlpools and in other facilities in which the participants or players are required to wear shorts, it is generally the more desirable practice to supply participants with disposable shorts than to expect them to bring and later carry away their own shorts. When players are supplied shorts that are discarded after use, one then has the assurance that all shorts used in the facility are fresh, clean and sterile, an assurance that is otherwise lacking.

The rising national concern with infectious diseases such as AIDS has caused many individuals to exercise great care to avoid infection by contact with those who suffer from such diseases. Hence these individuals are loath to wear any garment that had previously been worn by an unknown person, even though assured that this garment had undergone sterilization.

In my prior Pat. No. 4,327,448, entitled "Disposable Non-Woven Shorts", whose entire disclosure is incorporated herein by reference, there is disclosed shorts made of non-woven fabric sheeting that is die-cut to yield a pair of identical blanks of generally rectangular form whose lower section has a pair of crotch tabs extending therefrom in opposite directions. The blanks are superposed and their side margins are ultrasonically welded together to define a tube whose upper circular margin constitutes the waist of the shorts. Then the tabs of each blank are ultrasonically welded together at their ends to complete the crotch to define a pair of leg openings. Finally, an elastic band is ultrasonically welded in its stretched state to the inner circle of the waist to create a shirred waist which is expandable to conform to the waist size of the wearer.

While shorts of the type disclosed in my prior patent are disposable, because they are created from a pair of blanks and must be ultrasonically seamed at several sites on the blanks, the requisite manufacturing procedures are time-consuming and relatively expensive. The resultant costs are such that these shorts represent a significant expenditure when they are purchased in substantial quantities by a large general hospital or other facility making use of such shorts on a large scale.

Of background prior art interest are the following Pat. Nos.:

Curtius: 1,845,131
Gruenberg et al.: 2,638,900
Guinzburg: 1,314,799
Maxey: 2,905,581
McLaughlin: 2,462,414
Laskin: 1,985,933
Lesson: Re. 16,282

SUMMARY OF INVENTION

In view of the foregoing, the main object of this invention is to provide apparel shorts fabricated of a single blank of low-cost textile sheeting, whereby the shorts are inexpensive to manufacture and are therefore disposable after a single use. It is to be understood, however, that the material from which these shorts are made may be of the type that is machine-washable and sterilizable; hence in some situations the disposable shorts may be reused.

Also an object of the invention is to provide a technique for making shorts of the above type which lends itself to high-speed, low-cost mass production.

More particularly, an object of this invention is to provide apparel shorts fabricated of non-woven material, which shorts are expandable to accommodate a range of human waist sizes and different lower trunk sizes.

Briefly stated, these objects are attained in disposable apparel shorts fabricated from a single blank of non-woven textile sheeting, the blank having opposing isosceles triangular indentations therein whose vertices lie at the opposite ends of a transverse center line. When the blank is folded on this line to form identical superposed sections, these constitute the front and rear sections of the shorts in which the upper margins of the sections define the waist, and the folded-over triangular indentations define the legs openings. The side margins of the front section are folded in and the corresponding side margins of the rear section are folded over the folded-in margins to define side vents in the leg openings to provide additional space, should it be required by the wearer. An elastic band is bonded in its stretched state to the inner surface of the upper margins of the sections to create a shirred circular waist which is expandable to conform to the waist of the wearer.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

A non-woven material may generally be described as a coherent sheet of entangled or bonded fibers made without the fibers first being spun into yarns and thereafter interlaced by weaving, knitting, braiding or other means of yarn manipulation. Among the materials used in making non-woven fabrics are papers, needled felts, battings and other forms of textiles produced by forming synthetic fibers into a web and causing the fibers to adhere to each other.

While non-woven materials in the apparel field have been the subject of an enormous amount of interest, their actual use has been limited largely to interfacing and as felt-replacement materials for shoulder pads, belts, and the like. Non-woven fabrics have been considered for underwear and outerwear purposes, but little actual use has been made of them in this field.

Non-woven fabrics are not properly classified as disposable items, except in special cases where woven or knitted structures are also disposable, as in surgical bandages. Non-woven materials are basically permanent textiles. However, within the context of the present invention, where the desideratum is low cost, the choice of materials and the fabrication technique are deliberately such as to afford shorts having good wearability which, because it includes no investment in tailoring, may nevertheless be discarded without sacrifice after a single use.

In order to produce the shorts, use is preferably made of a flexible, non-woven textile sheeting whose material is entirely constituted by randomly-dispersed polyester fibers, such as the type known commercially under the trademark "Nexus" marketed by Burlington Industries. Polyester fibers is the generic name for a manufactured fiber in staple or continuous filament form in which the fiber-forming substance is any lone chain synthetic polymer composed of at least 85% by weight of an ester of a dihydric alcohol and terephthalic acid.

Polyester non-woven fabric of the "Nexus" type is relatively soft and satisfies Federal standards for non-flammability. The "Nexus" material is non-toxic and non-allergenic, and is sterilizable in laundering. Though shorts made of this material in the manner of the present invention are of low cost and therefore expandable, for purposes of greater economy the shorts may be reused, in that it may be safely washed repeatedly and sterilized. Also usable is DACRON 171, a trademarked duPont thermally bonded, non-woven fabric formed of DACRON polyester fibers which combines softness and strength. This sterilizable, non-woven fabric can be printed or dyed, so that highly decorative shorts can be produced.

Figure 1:
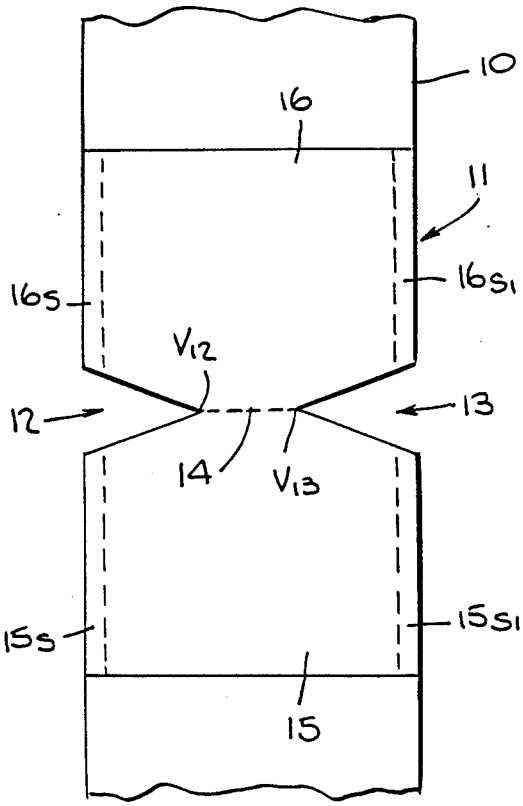
FIG. 1 shows the first step in a technique in accordance with the invention for producing shorts, the first step yielding a blank of non-woven fabric having two identical sections.

Referring now to FIG. 1, there is shown the first step in the shorts-producing technique in which a continuous sheeting 10 of "Nexus" or material having similar properties is advanced through a die cutter which successively yields identical blanks, only blank 11 being shown. In practice, instead of a continuous sheeting and a die cutting operation producing blanks in sequence, a stack of rectangular sheets may be die cut to produce a stack of blanks.

Blank 11, which is rectangular in form, is die cut to provide a pair of opposing isosceles triangular identations 12 and 13. The vertices $V_{12}$ and $V_{13}$ of these triangles lie at the opposite ends of a transverse fold line 14 (shown in a dotted line) which divides the blank into identical half sections 15 and 16. Each section has like side margins $\mathbf{15}_S$–$\mathbf{15}_{S1}$ and $\mathbf{16}_S$–$\mathbf{16}_{S1}$ whose boundaries are indicated in FIG. 1 in dotted lines.

Figure 2:
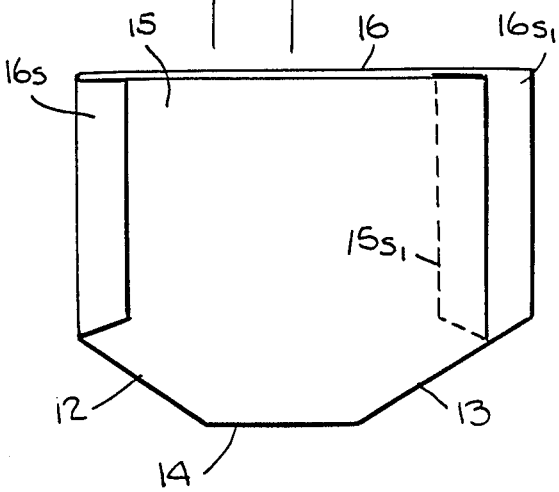
FIG. 2 shows the second step in which the sections are superposed and the side margins thereof are folded.

The next step is to convert the blank into the form of shorts. To do this, section 15 is folded over section 16, as shown in FIG. 2, on fold line 14, so that in the superposed sections, section 15 is the front section of the shorts and section 16 is the rear section thereof. The folded-over triangular indentations 12 and 13 define the leg openings of the shorts, the region therebetween bounded by fold line 14 forming the crotch. Side margins $\mathbf{15}_S$ and $\mathbf{15}_{S1}$ of front section 15 are folded in behind this section, and side margins $\mathbf{16}_S$ and $\mathbf{16}_{S1}$ are then folded over the folded-in side margins $\mathbf{15}_S$ and $\mathbf{15}_{S1}$ to define side vents in the leg openings. Hence if the wearer's lower trunk requires more space than is available in the shorts, the side vents yield to provide the additional space so that the shorts are not restricting and are comfortable.

Figure 3:
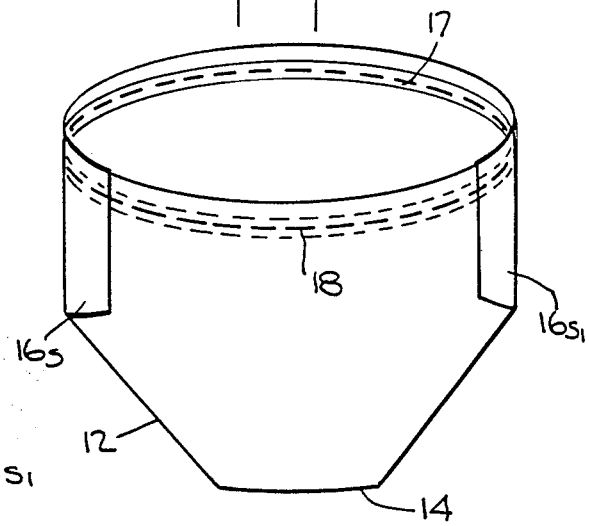
FIG. 3 shows the third step in which the shirred waist of the shorts is formed.

The final step is to complete the shorts by bonding a tape or band 17, as shown in FIG. 3, of elastomeric material to the inner circle of the waist of the shorts. This inner circle is formed by the inner surface of the upper margins of front and rear section 15 and 16 and the upper ends of the side vents. The band is bonded in its stretched state as by a line 18 of ultrasonic welding to the inner circle so that upon completion of this weld, when the tension of the band is released, the band then returns to its original length and in doing so acts to shirr or pucker the waist of the shorts.

Ultrasonic welding to seam thermoplastic material is accomplished by introducing the plies of material to be welded between a "sonotrode" and an anvil. The sonotrode is caused to vibrate at an ultrasonic frequency and exerts an oscillatory pressure on the material, whereby ultrasonic energy is transformed into heat. This heat softens the superposed plies of non-woven thermoplastic material and causes them to fuse together. The amount of heat generated is controlled by the adjusted amplitude of ultrasonic vibration.

In practice, instead of ultrasonically bonding an elastomeric band to the inner circle of the waist, use may be made of a self-adhering elastomeric material for this purpose of the type disclosed in Pat. Nos. 4,259,220 and 4,418,123.

Figure 4:
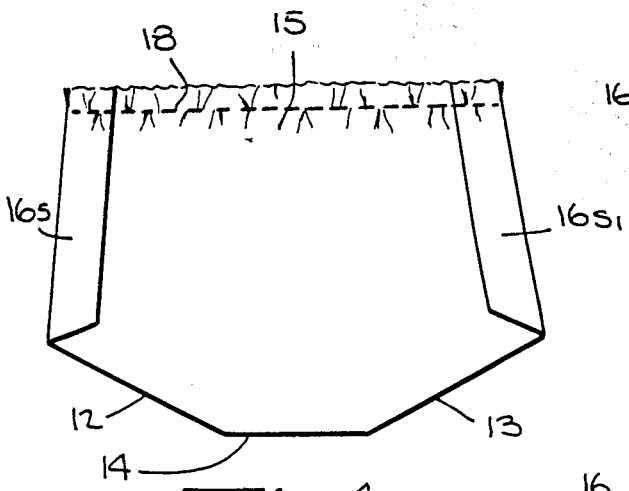
FIG. 4 is a front view of shorts in accordance with the invention.
Figure 5:
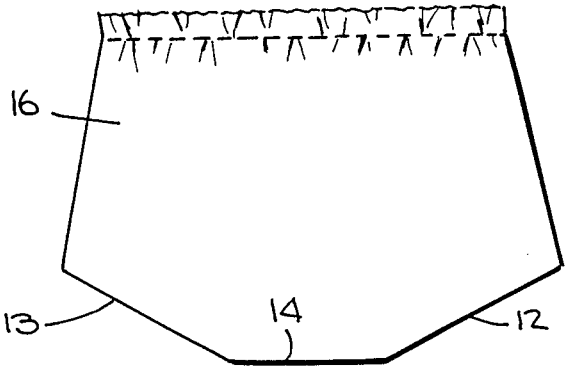
FIG. 5 is a rear view thereof.

Thus, as shown in FIGS. 4 and 5, the completed shorts has an expandable puckered waist that can accommodate itself to the waist size of the wearer within certain limits. While it is not possible with shorts of this type to have a single size for all wearers, because of its limited waist adjustability, three sizes (small, medium and large) may be provided for the full range of normally-encountered body sizes.

While there has been shown and described a preferred embodiment of disposable, non-woven apparel shorts in accordance with the invention, it will be appreciated that many changes and modifications may be made therein without, however, departing from the essential spirit thereof. For example, instead of using non-woven textile material, use may be made of low-cost woven-material or material which is textured so as to render it highly absorbent. And in the case of incontinent patients, the material may be of the laminated type having an outer liquid-impermeable ply and a highly absorbent inner ply.

I claim:

1. Apparel shorts formed of a single rectangular blank of textile material formed of non-woven polyester fibers having a pair of opposing isosceles triangular indentations therein whose vertices lie at the opposite ends of a transverse center line, the blank being folded in half on the center line to create identical front and rear sections in superposed relation, the folded-over triangular identations then defining leg openings, the side margins of the front section being folded in behind this section, and the corresponding side margins of the rear section being folded over the folded-in margins of the front section to define side vents in the leg openings to provide additional space in the shorts should it be required by the wearer, and a continuous band of elastomeric material bonded in its stretched state to the inner surface of the upper margins of the front and rear sections and the upper ends of the side vents to form a circular waist, whereby when the band is released, it creates a shirred, expandable, multi-size waist.

2. Apparel shorts as set forth in claim 1, wherein said band is ultrasonically welded to the inner surface.

3. A technique for producing shorts comprising the steps of:

A. die-cutting a sheet of non-woven polyester textile material to produce a single rectangular blank having a pair of opposing isosceles triangular indentations therein whose vertices lie at the opposite ends of a transverse center fold line;

B. folding the blank in half on the center line to create indentical front and rear sections in superposed relation in which the folded over triangular indentations define leg openings and the region between the leg openings define the crotch of the shorts;

C. folding in the side margins of the front section behind this section;

D. folding the corresponding side margins of the rear section over the folded in margins of the front section to define side vents in the leg openings; and E. bonding to the inner surface of the upper margins of the front and rear sections and the upper ends of the side vents a continuous band of elastomeric tape that is stretched before it is bonded to form a circular waist, the tape when released acting to shirr the waist.

* * * * *